US005196112A

United States Patent [19]

Eichman

[11] Patent Number: 5,196,112

[45] Date of Patent: Mar. 23, 1993

[54] OIL DRAIN APPARATUS

[76] Inventor: James F. Eichman, R.R. 1, Box 45, Plainville, Kans. 67663

[21] Appl. No.: 797,367

[22] Filed: Nov. 25, 1991

[51] Int. Cl.[5] ..... B01D 35/02

[52] U.S. Cl. ..... 210/171; 210/223; 210/232; 210/238; 210/248; 210/DIG. 17; 210/422; 184/1.5; 123/196 A

[58] Field of Search ..... 210/232, 222, 223, 238, 210/248, 440, 443, 171, DIG. 17, 168, 420, 422; 184/1.5; 123/196 R, 196 A

[56] References Cited

U.S. PATENT DOCUMENTS

| | | | |
|---|---|---|---|
| 1,584,505 | 5/1926 | Bevins | 184/1.5 |
| 4,033,432 | 7/1977 | Bernstein | 184/1.5 |
| 4,406,784 | 9/1983 | Cochran | 123/196 A |
| 4,452,695 | 6/1984 | Schmidt | 210/232 |
| 4,719,012 | 1/1988 | Groezinger et al. | 210/232 |
| 4,859,328 | 8/1989 | Groezinger et al. | 210/232 |
| 4,930,602 | 6/1990 | Gust | 184/1.5 |
| 4,948,503 | 8/1990 | Baumann et al. | 210/232 |
| 4,977,978 | 12/1990 | Batrice | 184/1.5 |
| 4,986,777 | 1/1991 | Preston | 184/1.5 |

*Primary Examiner*—Peter Hruskoci
*Assistant Examiner*—Robert James Popovics
*Attorney, Agent, or Firm*—Leon Gilden

[57] ABSTRACT

An oil drain apparatus is directed into an oil filter boss in an operative association with a valve to permit selective flow of oil from the valve directed from the oil filter boss. The invention is directed to further include a flexible hose positioned in tension directed through a housing, with its lower distal end positioned above a magnetic grid to permit visual observation of debris directed from the associated internal combustion engine.

1 Claim, 4 Drawing Sheets

OIL DRAIN APPARATUS

BACKGROUND OF THE INVENTION

1. Field of the Invention

The field of invention relates to oil drain apparatus, and more particularly pertains to a new and improved oil drain apparatus wherein the same is arranged for association with an associated tractor structure.

2. Description of the Prior Art

Various tractor organizations, such as typified by the "John Deere" tractor structures, and particularly such models as the models 30, 40, 50, and 55, are arranged with oil drainage of peculiar problems, wherein the instant invention attempts to address these problems by providing an outflow conduit in association with an oil drain from an oil filter boss plate to permit ease of oil flow therefrom.

Prior art organizations of filter construction are exemplified in the U.S. Pat. Nos. 4,719,012; 4,859,328; and 4,948,503. An oil system is illustrated in U.S. Pat. No. 4,930,602 to Gust wherein disposable containers are positioned below and in operative communication with an overlying tray to direct oil flow into the various bottles.

As such, it may be appreciated that there continues to be a need for a new and improved oil drain apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of oil drain apparatus now present in the prior art, the present invention p·ovides an oil drain apparatus wherein the same is arranged for the ease of drainage of oil, and particularly engine oil, from associated internal combustion engines. As such, the general purpose of the present invention, which will be described subsequently in greater detail, is to provide a new and improved oil drain apparatus which has all the advantages of the prior art oil drain apparatus and none of the disadvantages.

To attain this, the present invention provides an oil drain apparatus directed into an oil filter boss in an operative assocaition with a valve to permit selective flow of oil from the valve directed from the oil filter boss. The invention is directed to further include a flexible hose positioned in tension directed through a housing, with its lower distal end positioned above a magnetic grid to permit visual observation of debris directed from the associated internal combustion engine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil drain apparatus which has all the advantages of the prior art oil drain apparatus and none of the disadvantages.

It is another object of the present invention to provide a new and improved oil drain apparatus which may be easily and efficiently manufactured and marketed.

It is a further object of the present invention to provide a new and improved oil drain apparatus which is of a durable and reliable construction.

An even further object of the present invention is to provide a new and improved oil drain apparatus which is susceptible of a low cost of manufacture with regard to both materials and labor, and which accordingly is then susceptible of low prices of sale to the consuming public, thereby making such oil drain apparatus economically available to the buying public.

Still yet another object of the present invention is to provide a new and improved oil drain apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
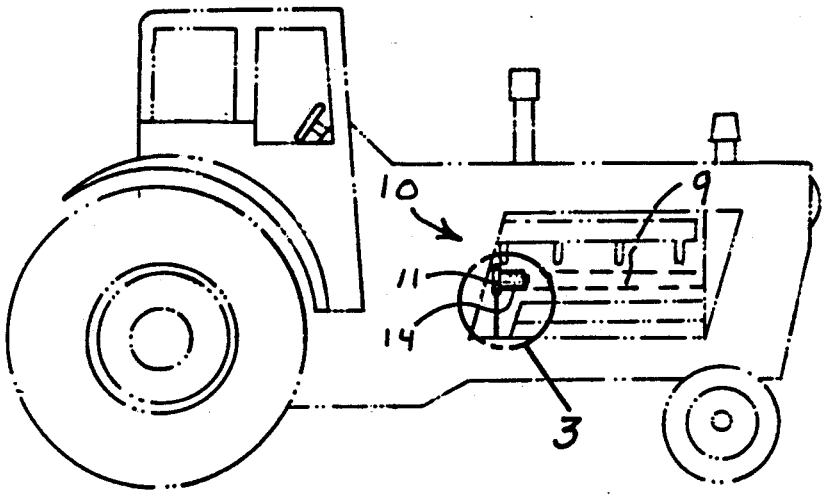
FIG. 1 is an orthographic side view of the instant invention mounted relative to a tractor structure.
Figure 2:
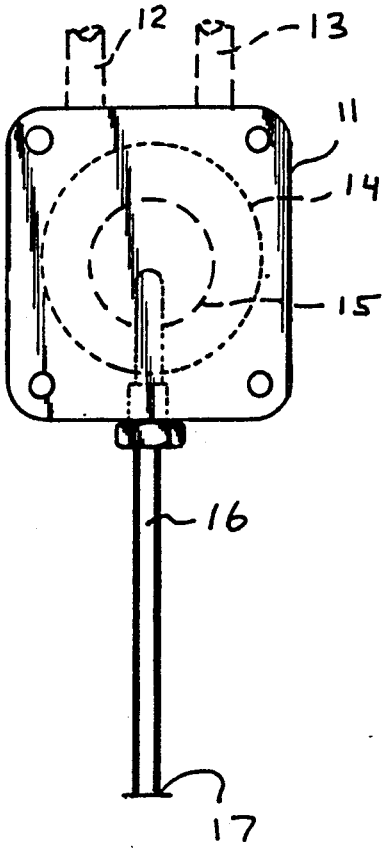
FIG. 2 is an orthographic rear view of the mounting block of the invention.
Figure 3:
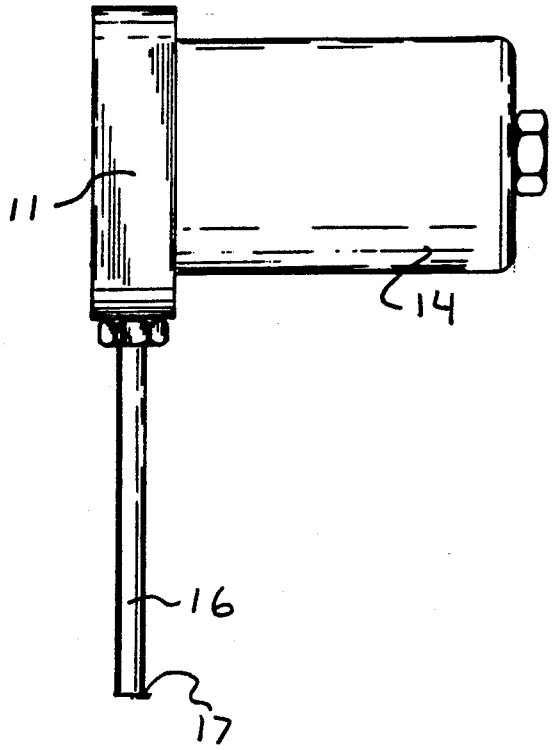
FIG. 3 is an orthographic side of the mounting block of the invention.
Figure 4:
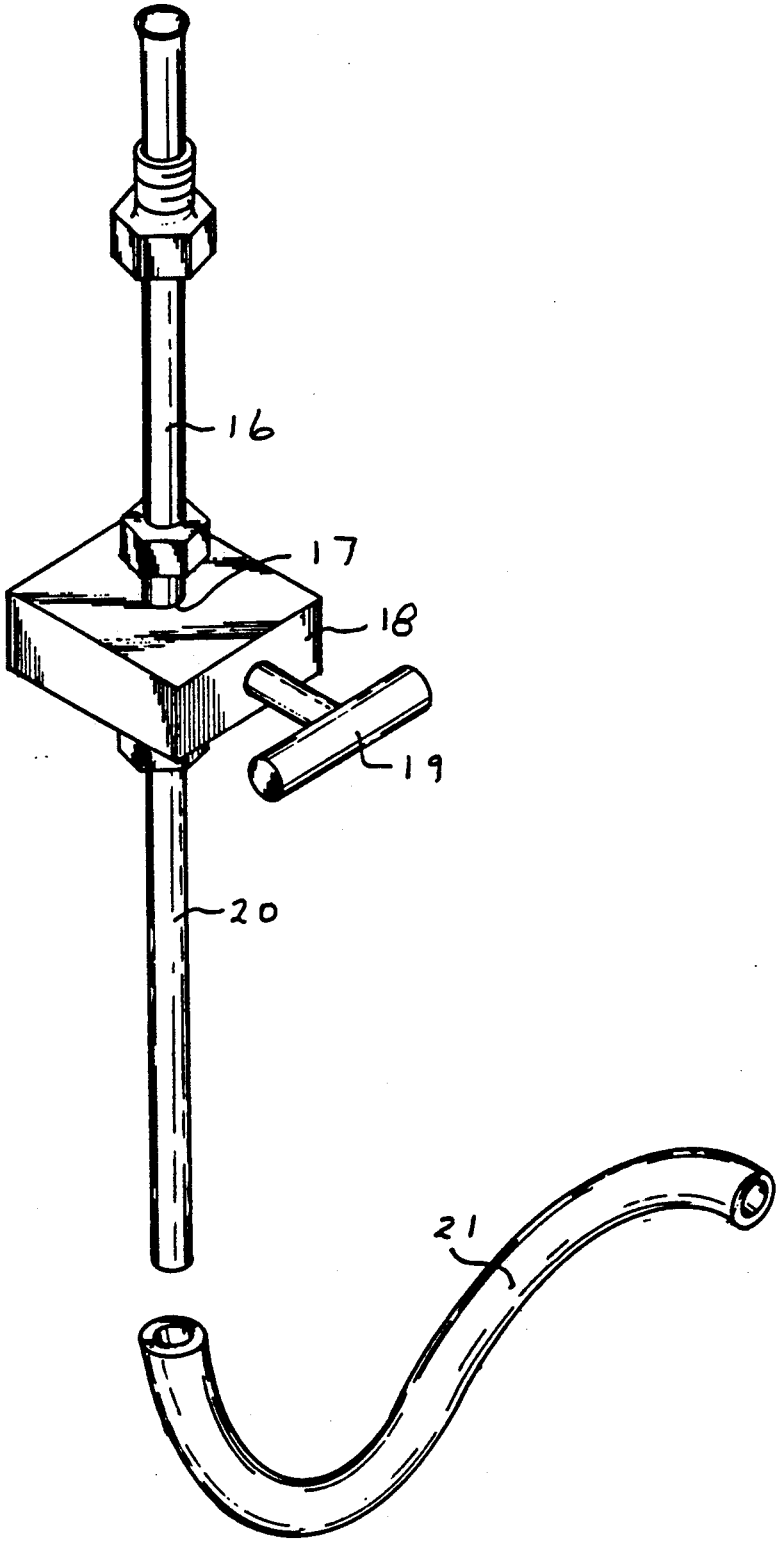
FIG. 4 is an isometric illustration of a valve structure arranged in association with the oil drain apparatus, as set forth in FIGS. 2 and 3.

With reference now to the drawings, and in particular to FIGS. 1 to 8 thereof, a new and improved oil drain apparatus embodying the principles and concepts of the present invention and generally designated by the reference numeral 10 will be described.

Figure 5:
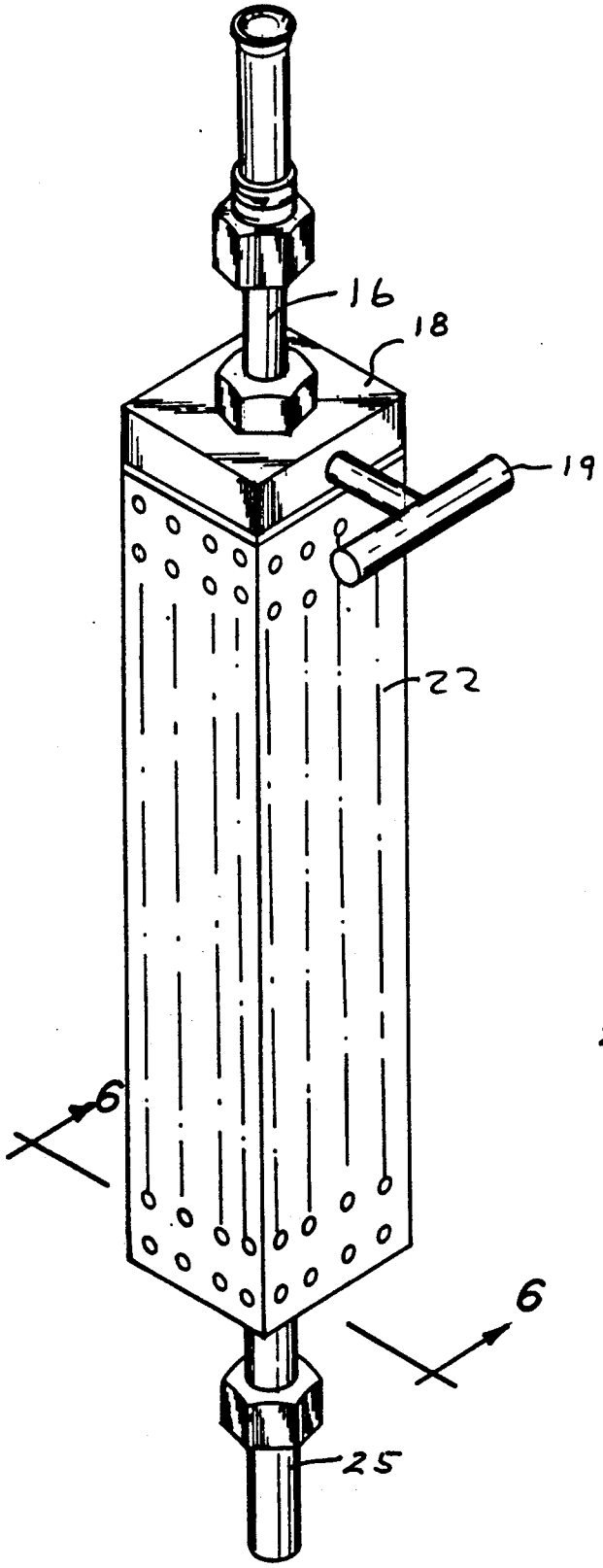
FIG. 5 is an isometric illustration of a protective housing arranged for use in surrounding relationship relative to a flexible housing of the invention.
Figure 6:
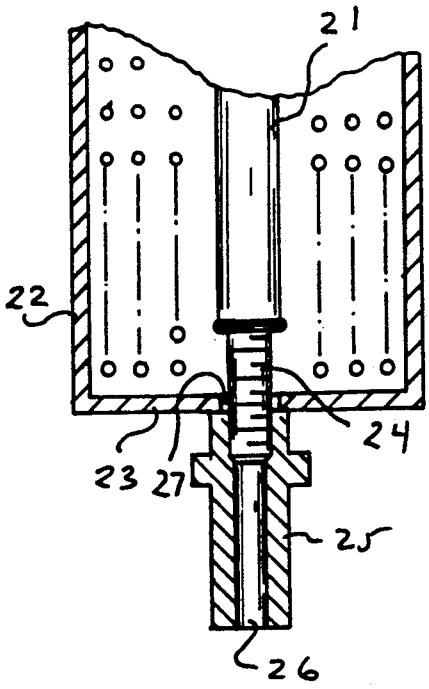
FIG. 6 is an orthographic view, taken along the lines 6—6 of FIG. 5 in the direction indicated by the arrows.

More specifically, the oil drain apparatus 10 of the instant invention essentially comprises an oil filter mounting block 11 arranged in fixed securement to an associated tractor frame 9, as illustrated in FIG. 1. Alternatively, the block may be mounted relative to the associated internal combustion engine at a lowermost point thereof to insure gravity flow of oil to the block during cessation of engine operation. An oil inflow conduit 12 and an oil flow output conduit 13 are directed relative to the internal combustion engine to provide for constant flow to the internal combustion engine through the mounting block 11 and through an associated oil filter canister 14. A mounting block oil flow central conduit 15 directed through a lower wall of the block is directed downwardly therefrom terminating in a lower distal end that is secured within a valve member 18 (see FIG. 4). A valve member 18 includes a handle 19 arranged for selective opening and closing of the valve to permit oil flow from the output conduit 16 through the valve member 18 into an associated valve member output conduit 20 directed below the valve member and secured at its lower distal end to an associated flexible hose 21. The flexible hose 21 may be utilized to permit directing of oil flow from the associated mounting block 11, or alternatively may be directed through, as illustrated in FIG. 5, a protective housing 22, including a housing floor 23 spaced below the valve 18 mounted to an upper distal end of the housing 22. A flexible hose lower externally threaded rigid portion 24 is directed through a housing floor bore 27 directed through the floor 23, with an internally threaded lock boss 25 threadedly secured to the rigid portion 24, with the lock boss including a lock boss bore 26 in fluid communication with the flexible hose 21 through the rigid portion 24. The lock boss 25 is defined by a first diameter greater than a second diameter defined by the bore 27 to effect tensioning and alignment of the flexible hose 21 within the housing 22.

Figure 7:
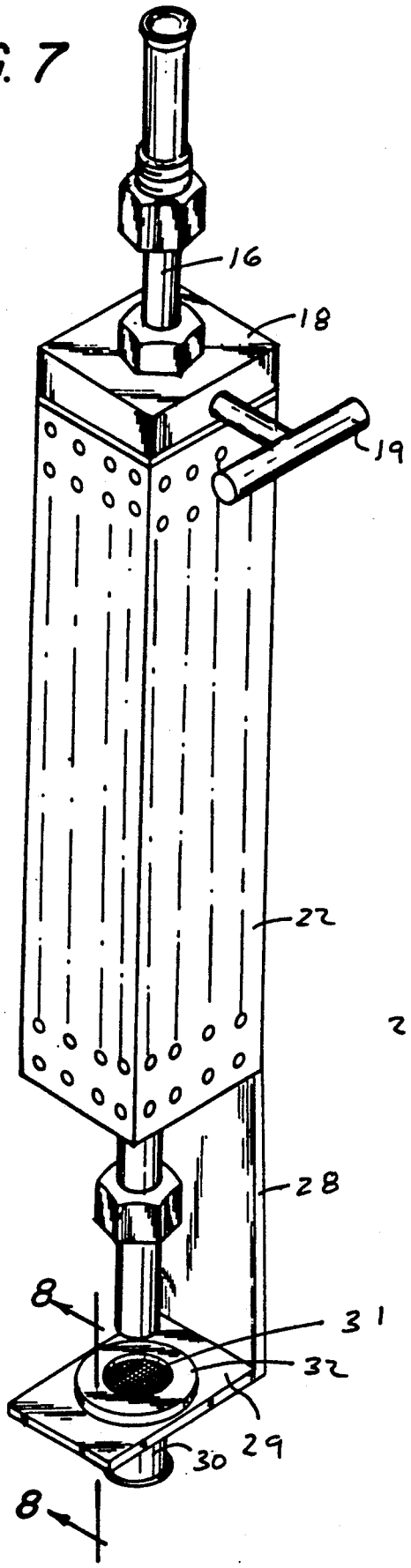
FIG. 7 is an isometric illustration of a modified housing structure utilized by the invention.
Figure 8:
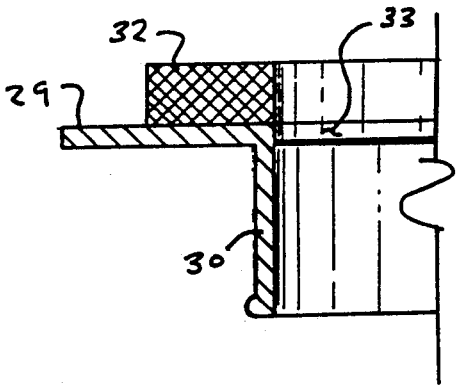
FIG. 8 is an orthographic view, taken along the lines 8—8 of FIG. 7 in the direction indicated by the arrows.

Further, as illustrated in FIGS. 7 and 8, an "L" shaped flange including a first flange 28 mounted to the housing floor directed downwardly thereof terminates in a second flange 29 orthogonally mounted to the first flange 28, with the second flange 29 positioned below the floor 23 in confrontation therewith and including a second flange bore 33 directed therethrough. The second flange bore 33 is coaxially aligned with the lock boss bore 26 and includes a magnetic screen 31 mounted thereover, with a magnetic ring 32 mounted in surrounding relationship relative to the bore securing the magnetic screen 31 therewithin. In this manner, metallic contaminants from an oil filtering procedure may be visually presented on the screen 31 for consideration of engine deterioration and contaminants contained therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oil drain apparatus arranged for securement to a self-propelled vehicle, wherein the vehicle includes an internal combustion engine, and the internal combustion engine includes an oil filter mounting block, the apparatus comprises in combination, the oil filter mounting block wherein the oil filter mounting block includes an oil inflow conduit and an oil outflow conduit directed thereto, and an oil filter canister mounted to the oil filter mounting block, and the mounting block further including a mounting block bottom surface positioned below the oil filter canister, and the mounting block bottom surface including a mounting block output central conduit in fluid communication with the oil filter canister, and the output conduit including an output conduit lower distal end, and the output conduit lower distal end in fluid communication with a valve member, and the valve member arranged in fluid communication with the output conduit, including a valve member handle to permit selective fluid flow through the valve member, and the valve member including a valve member output conduit, and the valve member output conduit is rigid, and the valve member output conduit including a valve member output conduit lower distal end, the valve member output conduit lower distal end including a flexible hose mounted thereto in fluid communication therewith, and the flexible hose directed downwardly relative to the valve member output conduit to permit selective orientation of the flexible hose relative to the valve member output conduit, and a protective housing, with the flexible hose directed through the protective housing, and the flexible hose including a flexible hose lower externally threaded rigid end portion defined by a predetermined external diameter, and the housing including a housing floor, the housing floor including a housing floor bore defined by a bore diameter greater than the predetermined diameter, and an internally threaded lock boss mounted to an exterior surface of the housing floor threadedly receiving the rigid end portion therewithin, and the internally threaded lock boss including a lock boss bore in fluid communication with the flexible hose through the rigid end portion, and wherein the housing is arranged in surrounding relationship relative to the flexible hose, and the housing floor includes a first flange directed downwardly therefrom, and a second flange integrally and orthogonally mounted to the first flange, the second flange including a second flange bore spaced below and coaxially aligned with the lock boss bores, and the second flange bore includes a ferromagnetic screen directed across the second flange bore, and a magnetic torroidal ring arranged in surrounding relationship relative to the magnetic screen and the second flange bore.

* * * * *